US006137980A

United States Patent [19]

Lee

[11] Patent Number: 6,137,980

[45] Date of Patent: Oct. 24, 2000

[54] DEVELOPING MACHINE

[75] Inventor: Hyun-Cheol Lee, Seoul, Rep. of Korea

[73] Assignee: SamSung Electronics Co., Ltd., Suwon, Rep. of Korea

[21] Appl. No.: 09/323,208

[22] Filed: Jun. 1, 1999

[30] Foreign Application Priority Data

May 29, 1998 [KR] Rep. of Korea ..... 98/19916

[51] Int. Cl.[7] ..... G03G 15/09

[52] U.S. Cl. ..... 399/274

[58] Field of Search ..... 399/265, 267, 399/274, 276, 277, 284

[56] References Cited

U.S. PATENT DOCUMENTS

| | | | |
|---|---|---|---|
| 4,916,492 | 4/1990 | Hoshika et al. | 399/274 X |
| 4,940,014 | 7/1990 | Saijo et al. | 399/276 X |
| 5,212,344 | 5/1993 | Kageyama et al. | 399/274 X |
| 5,296,328 | 3/1994 | Fuji et al. | 399/267 X |
| 5,442,425 | 8/1995 | Yokoyama et al. | 399/276 |
| 5,446,526 | 8/1995 | Shimizu | 399/276 |
| 5,464,720 | 11/1995 | Baba et al. | 399/274 X |
| 5,485,254 | 1/1996 | Bogoshian et al. | 399/274 |
| 5,503,106 | 4/1996 | Kaneko | 399/276 X |
| 5,771,426 | 6/1998 | Oka et al. | 399/267 X |

*Primary Examiner*—Sandra Brase
*Attorney, Agent, or Firm*—Robert E. Bushnell, Esq.

[57] ABSTRACT

A developing machine comprising a photosensitive drum for forming an electrostatic latent image on a face thereof, a developing roller for supplying a developing agent to the photosensitive drum, a doctor blade for controlling a thickness of a developing agent layer on the developing roller, a slanted face which is adjacent to the developing roller and prevents movement of the developing agent, a blocking jaw for blocking the developing agent so that a flow of the developing agent is generated and a magnetic roller which is mounted in the developing roller. The magnetic roller is comprised of a plurality of pieces of block magnets which are arranged alternately at particular angles.

20 Claims, 8 Drawing Sheets

DEVELOPING MACHINE

CLAIM OF PRIORITY

This application makes reference to, incorporates the same herein, and claims all benefits accruing under 35 U.S.C. § 119 from an application entitled DEVELOPING APPARATUS earlier filed in the Korean Industrial Property Office on the day of May 29$^{th}$ 1998, and there duly assigned Ser. No. 98-19916, a copy of which is annexed hereto.

BACKGROUND OF THE INVENTION

1. Field of the Invention

The present invention relates to a developing machine for developing an electrostatic latent image which is formed on a photosensitive drum, and more particularly to the toner distribution mechanism of a developing machine.

2. Description of the Related Art

In an electrophotographic developing machine, a developing agent in which a non-magnetic toner is mixed with a carrier has been used. More recently, a new developing agent in which a magnetic toner is mixed with a carrier has been used. Generally, a developing method employing a magnetic brush is used with the above two developing agents. In this case, the toner and the carrier are agitated with each other and are charged with electricity, whereby the toner is charged with a negative charge and the carrier is charged with a positive charge. The toner, having a negative charge, forms a shape of the brush with the carrier by the magnetic force of a magnetic roller which is mounted in a developing roller and is returned by a rotation of the developing roller and then develops an electrostatic latent image on a photosensitive drum. In this process, in order to control the thickness of the developing agent layer, a doctor blade is used.

In order to obtain a high picture quality in the above developing machine, it is important to maintain uniformly the toner concentration on the developing roller. To this end, a proper amount of developing agent should be always stored in a developing part of the developing machine. When the developing roller is idled without consumption of the developing agent, the developing agent should be not removed to the outside. In addition, when the developing agent is only partially consumed due to the particular sizes of the images, there should be provided a mechanism for returning the developing agent at a border between the developing part and a toner supplying part so that the developing agent is supplied only to the consumed area.

A conventional developing machine has a housing, a photosensitive drum on which an image is formed, a developing agent formed of magnetic particles having a diameter of 40–100 $\mu$m, magnetic toner having a diameter of 10–20 $\mu$m, a developing roller having an axis and a magnetic roller which is disposed in the developing roller and composed of alternating magnets N1, S1, N2, S2, N3, S3. The developing agent is composed of ferrite or magnetite.

Additionally, the conventional developing machine has a doctor blade for controlling the thickness of the developing agent layer, a toner supplying roller for supplying the magnetic toner to the developing roller and a rib for preventing a movement of the developing agent. The rib is mounted on a portion in which the developing agent remains. The rib is fixed on a frame by a screw. Further, the rib controls movement of the developing agent in the axial direction of the developing roller.

In another conventional developing machine, a rib is integrally projected from the rear face of a doctor blade.

However, in both discussed conventional developing machines, the ribs are provided only to prevent the axial movement of the developing agent, due to vibration and inclination of the developing machine or pressure of the magnetic toner which is returned.

Therefore, as described above, when the developing roller is idled without consumption of the developing agent, the ribs prevent the axial movement of the developing agent, due to vibration and inclination of the developing machine. However, when actually printing an image, since there is a large difference between the input amount of the developing agent at the front of the doctor blade and the output amount at the rear of the doctor blade, the developing agent which is not output flows intensively. The developing agent flows down along the ribs. Therefore, a portion of the developing agent secedes from the developing part to the toner supplying part, and an imbalance of the concentration of toner is generated on the developing roller.

SUMMARY OF THE INVENTION

It is therefore an object of the present invention to provide an improved multipurpose printing apparatus.

It is a further object of the present invention to provide an improved developing machine for a printing apparatus.

It is a yet further object of the present invention to provide a developing machine with improved picture quality.

It is a still further object of the present invention to provide a developing machine which prevents an imbalance of concentration of the toner on the developing roller.

It is another object of the present invention to provide a developing machine which does not use a sensor for detecting the concentration of the toner.

It is yet another object of the present invention to provide a less expensive developing machine.

To achieve the above objects and other advantages, there is provided a developing machine comprising a photosensitive drum for forming an electrostatic latent image on a face thereof, a developing roller for supplying a developing agent to the photosensitive drum, a doctor blade for controlling a thickness of a developing agent layer on the developing roller, a slanted face which is adjacent to the developing roller and prevents a movement of the developing agent, a blocking jaw for blocking the developing agent so that a flow of the developing agent is generated and a magnetic roller which is mounted in the developing roller, wherein the magnetic roller is comprised of a plurality of pieces of block magnets which are arranged at each angle.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
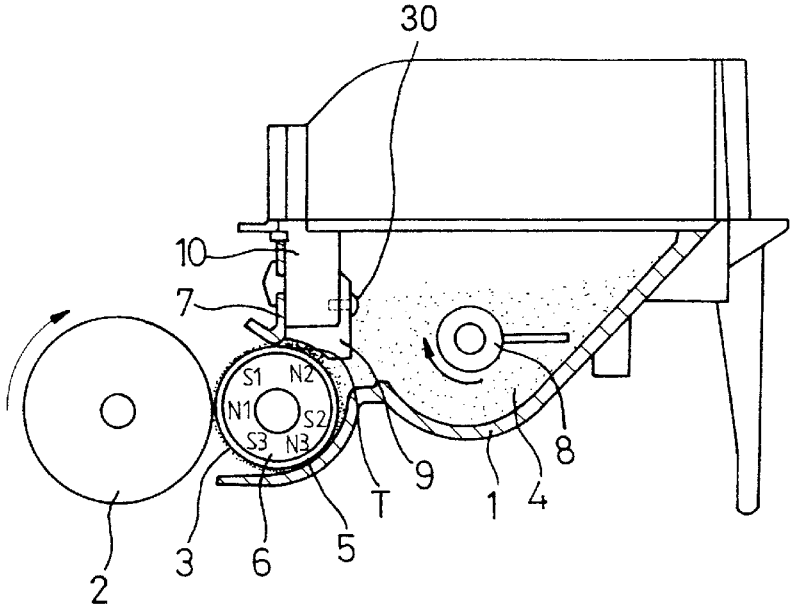
FIG. 1 (Prior Art)
FIG. 1 is a longitudinal sectional view of a conventional developing machine.
Figure 2:
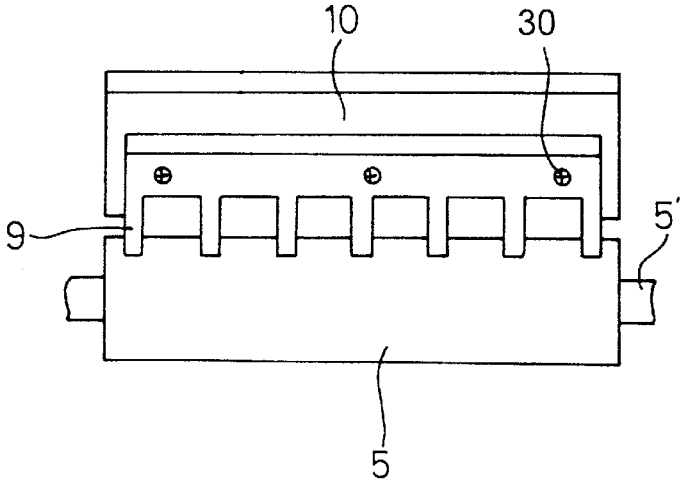
FIG. 2 (Prior Art)
FIG. 2 is a front view of the conventional developing machine.

Turning now to the drawings, the conventional developing machines discussed above will be shown in detail. FIG. 1 shows a cross-sectional view of a conventional developing machine, and FIG. 2 is a front view of the conventional developing machine. In FIGS. 1 and 2, reference numeral 1 indicates a housing, 2 is a photosensitive drum on which an image is formed, 3 is a developing agent formed of magnetic particles having a diameter of 40–100 μm, 4 is magnetic toner having a diameter of 10–20 μm, 5 is a developing roller, 5' is a axis of the developing roller and 6 is a magnetic roller which is disposed in the developing roller 5 composed of alternating magnets N1, S1, N2, S2, N3, S3. The developing agent is composed of ferrite or magnetite.

And, the reference numeral 7 is a doctor blade for controlling the thickness of the developing agent layer, 8 is a toner supplying roller for supplying the magnetic toner 4 to the developing roller 5 and 9 is a rib for preventing a movement of the developing agent 3. The rib 9 is mounted on a portion T in which the developing agent 3 is remained. The rib 9 is fixed on a frame 10 by a screw 30. Further, the rib 9 controls movement of the developing agent 3 in the axial direction of the developing roller 5.

Figure 3:
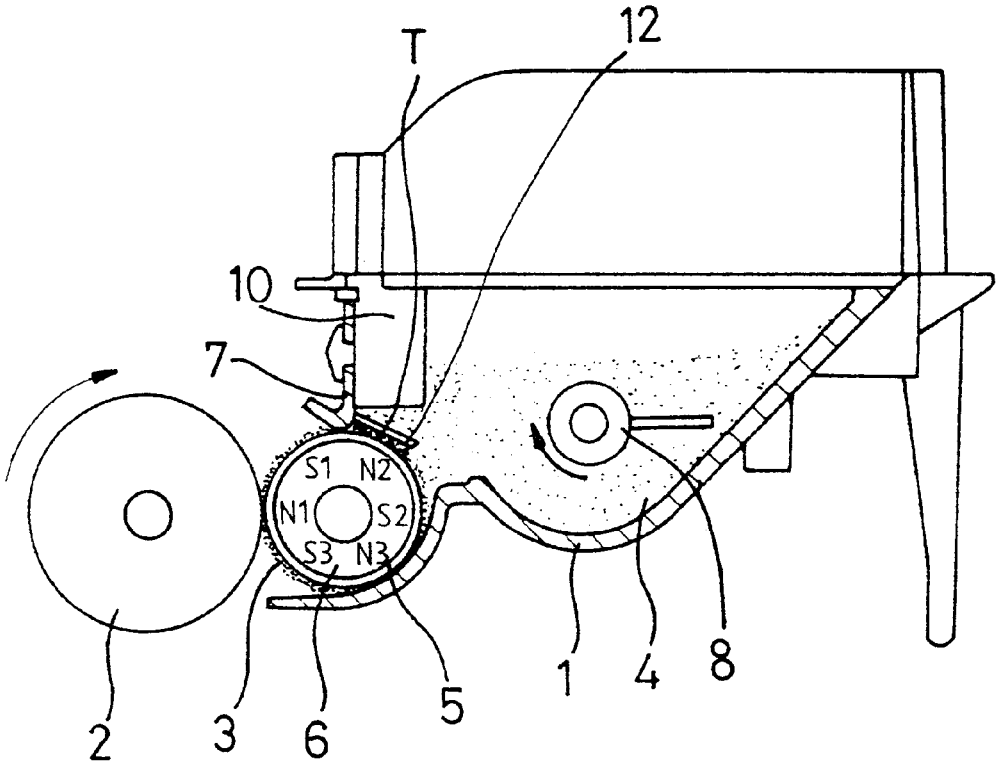
FIG. 3 (Prior Art)
FIG. 3 is a longitudinal sectional view of another conventional developing machine.

FIG. 3 shows another conventional developing machine. In FIG. 3, a rib 12 is integrally projected from the rear face of a doctor blade. However, in both conventional developing machines, the ribs 9, 12 are provided only to prevent the axial movement of the developing agent 3, due to vibration and inclination of the developing machine or pressure of the magnetic toner which is returned.

Therefore, as described above, when the developing roller is idled without a consumption of the developing agent, the ribs 9, 12 prevent the axial movement of the developing agent 3, due to vibration and inclination of the developing machine. However, when actually printing an image, since there is a large difference between the input amount of the developing agent 3 at the front of the doctor blade 7 and the output amount at the rear of the doctor blade, the developing agent 3 which is not output flows intensively. The developing agent 3 flows down along the ribs 9, 12. Therefore, a portion of the developing agent 3 secedes from the developing part to the toner supplying part, and an imbalance of the concentration of toner is generated on the developing roller.

Figure 4:
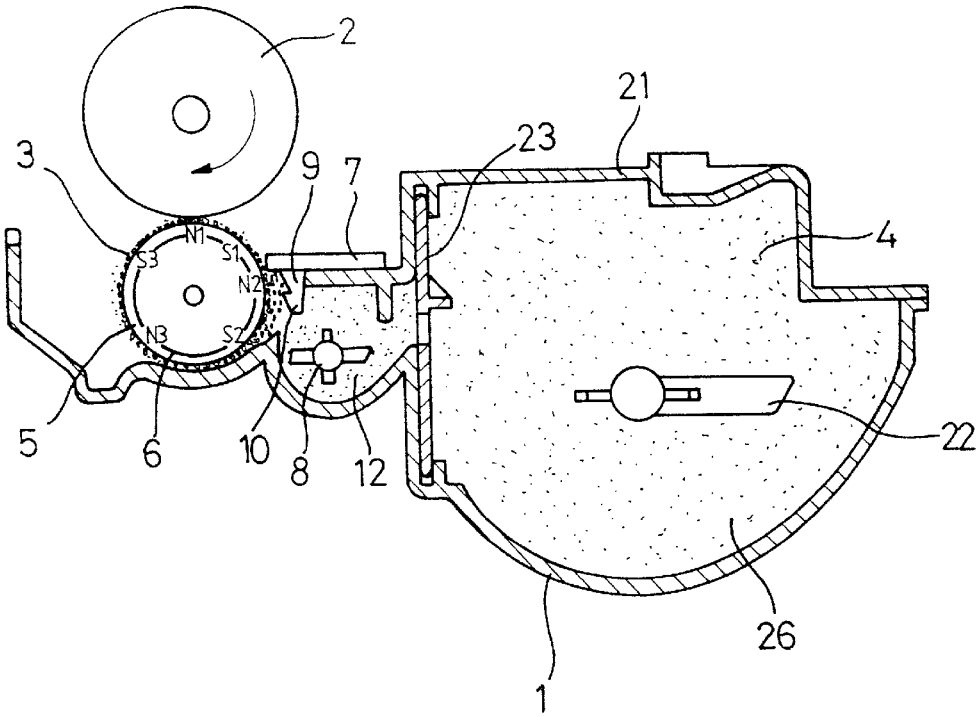
FIG. 4 is a longitudinal sectional view of a developing machine according to the present invention.
Figure 6A:
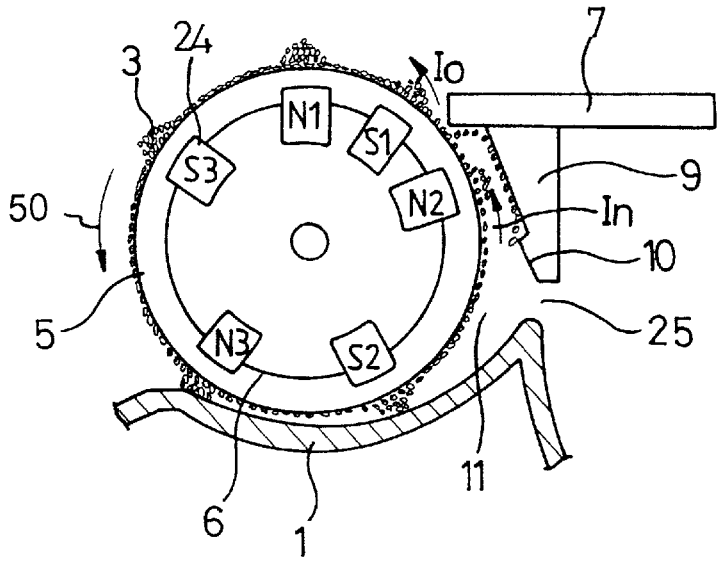
FIGS. 6A to 6C are sectional views showing a flow of a developing agent by an operation of the developing machine according to the present invention.
Figure 6B:
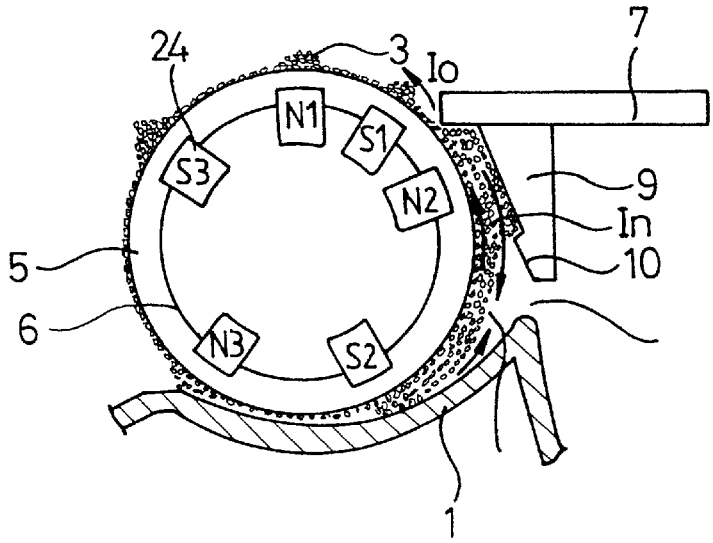
Figure 6C:
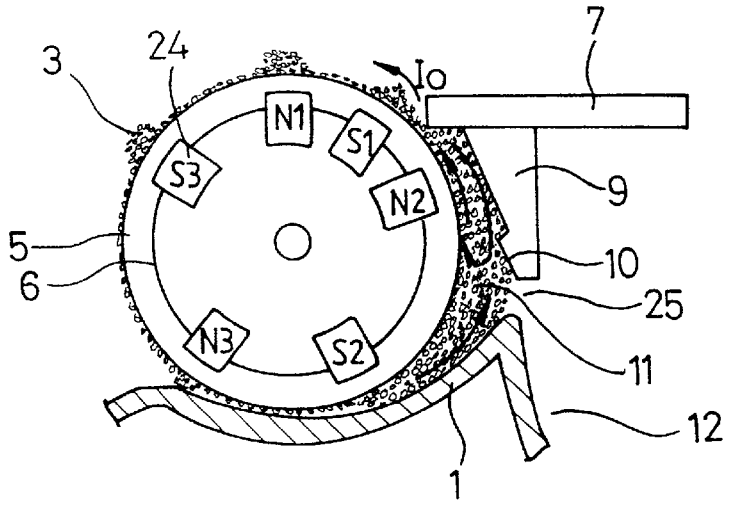
Figure 7A:
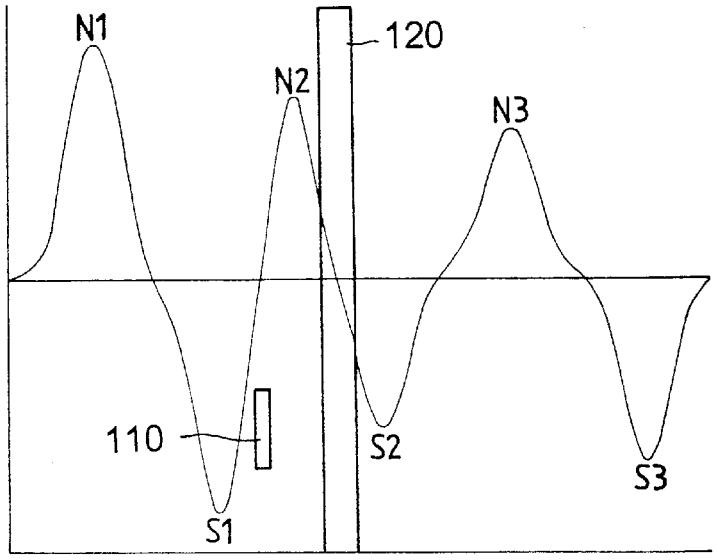
FIG. 7A is a view showing a characteristic curve of a normal force of a magnetic roller applied to the developing machine according to the present invention.
Figure 7B:
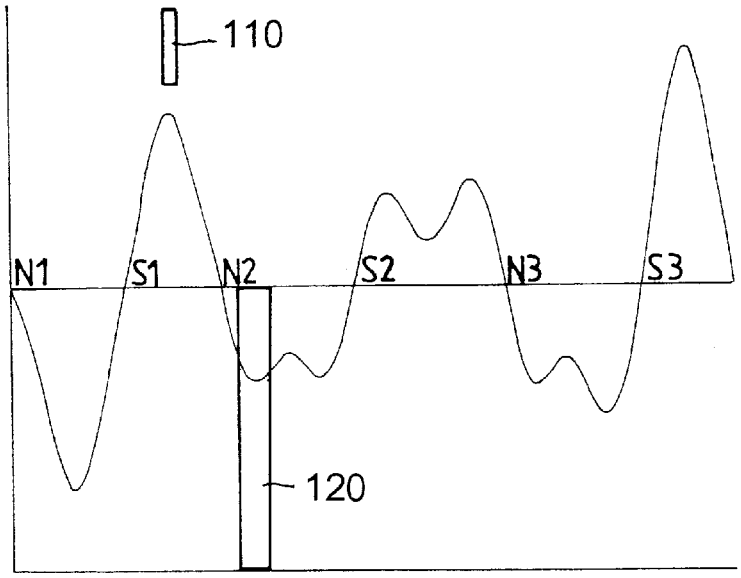
FIG. 7B is a view showing a characteristic curve of a tangential force of the magnetic roller applied to the developing machine according to the present invention.
Figure 7C:
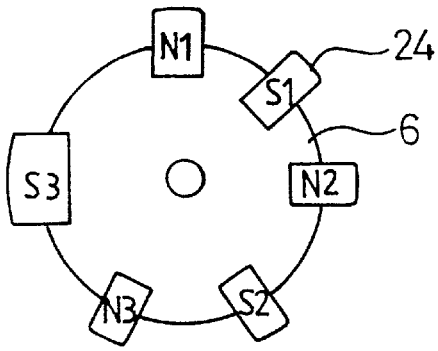
FIG. 7C is a view showing a structure of the magnetic roller applied to the developing machine according to the present invention.

The present invention now will be described more fully hereinafter with reference to the accompanying drawings, in which preferred embodiments of the invention are shown. FIG. 4 is a sectional view showing an embodiment of a developing machine according to the present invention, FIG. 5 is a enlarged detail showing a developing part including a developing roller of the developing machine, FIG. 6 is a view showing a flow of a developing agent in the developing part and FIGS. 7A to 7C are views showing characteristic curves of magnetic forces of a magnetic roller applied to the developing machine according to the present invention, a position of a doctor blade and a position of a border face of a toner supplying part.

Figure 5:
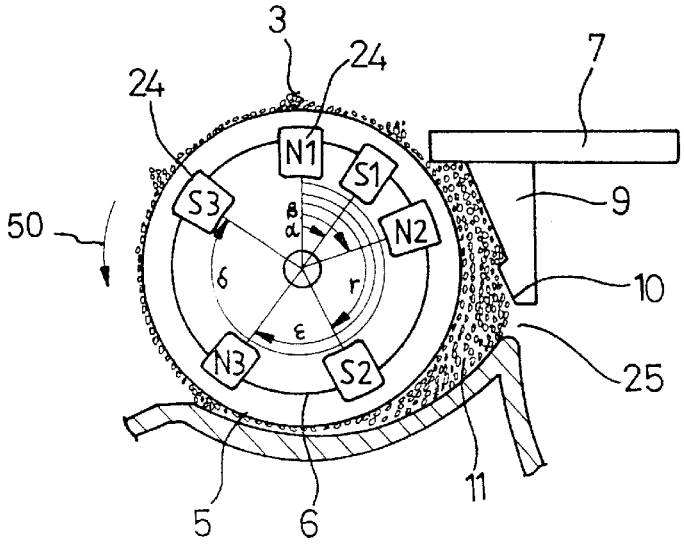
FIG. 5 is a enlarged detail of a portion of a developing roller of the developing machine according to the present invention.

In FIG. 5, as one of main features of the present invention, a slanted face 9 prevents any developing agent 3 which does not pass through doctor blade 7 and which accumulates under the doctor blade from moving into a toner supplying part 12, and also increases the density of the developing agent 3 which accumulates on an upper portion of the developing part 11. A blocking jaw 10 is integrally formed on an end of the slanted face 9 so that the highly dense developing agent 3 which is accumulated on the upper portion of the developing part 11, does not move to border face 25 and is maintained on the upper portion of the developing part 11. Therefore, the slanted face 9 and blocking jaw 10 are formed on the doctor blade 7.

In FIG. 4 and 5, reference numeral 11 indicates a developing part, 12 is a toner supplying part, and 26 is a hopper. The toner supplying part 12 and hopper 26 are divided from each other by a blocker 23 which is disposed in a groove formed in cover 21 and housing 1. The blocker 23 prevents a considerable amount of toner from gathering into the developing part 11 due to a tilt of the developing machine. A hopper roller 22 is disposed in the hopper 26 and is rotated so as to remove the toner into the toner supplying part 12. A toner supplying roller 8 is disposed in the toner supplying part 12 and is rotated so as to feed the removed toner to the developing part 11.

A magnetic roller 6 is comprised of six pieces of block magnets 24 (N1, S1, N2, S2, N3, S3) as shown in FIG. 5. The block magnets 24 are arranged at each of the angles $\alpha,\beta,\gamma,\epsilon,\delta$, and the characteristic curves of the magnetic roller are shown in FIGS. 7A and 7B. Specifically, FIG. 7A shows the normal force, or magnetic field strength, as a function of angular position on the roller, and FIG. 7B shows the tangential force as a function of angular position.

In FIG. 5, the height of the blocking jaw 10 is in the range of approximately 0.7 to 2 mm, and the width of the blocking jaw 10 is in the range of approximately 2 to 3 mm. The arranging angles of the block magnets 24(S1, N2, S2, N3, S3) with respect to the block magnet N1 are in the following approximate ranges: $\alpha$=35° to 45°, $\beta$=80° to 90°, $\gamma$=145° to 155°, $\epsilon$=215° to 225°, $\delta$=295° to 305°.

As shown in FIGS. 7A to 7B, the doctor blade 7 is radially disposed at position 110, between the magnetic poles S1 and N2, in which the absolute value of the normal force is at a minimum and the tangential force is maximum. The border part 25 between the developing part 11 and the toner supplying part 12 is placed at position 120, radially between the magnetic poles N2 and S2, in which the normal force is minimum and the tangential force is maximum.

Figure 8A:
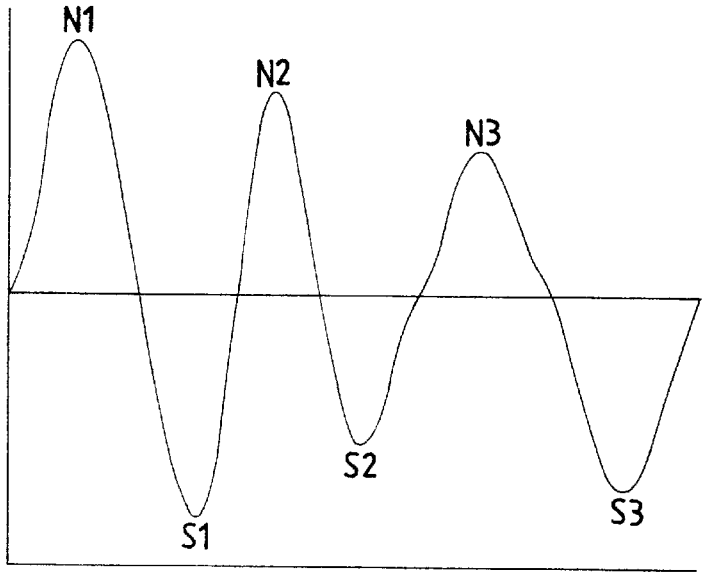
(Prior Art) FIG. 8A
FIG. 8A is a view showing a characteristic curve of a normal force of a magnetic roller applied to the conventional developing machine.
Figure 8B:
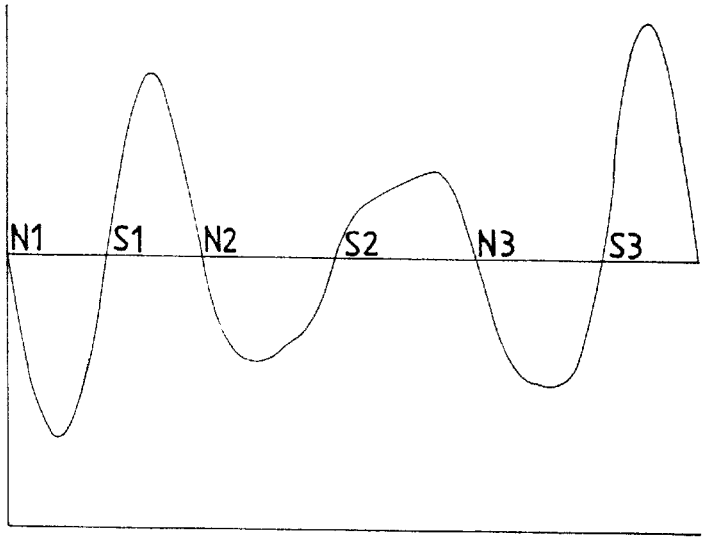
(Prior Art) FIG. 8B
FIG. 8B is a view showing a characteristic curve of a tangential force of the magnetic roller applied to the conventional developing machine.
Figure 8C:
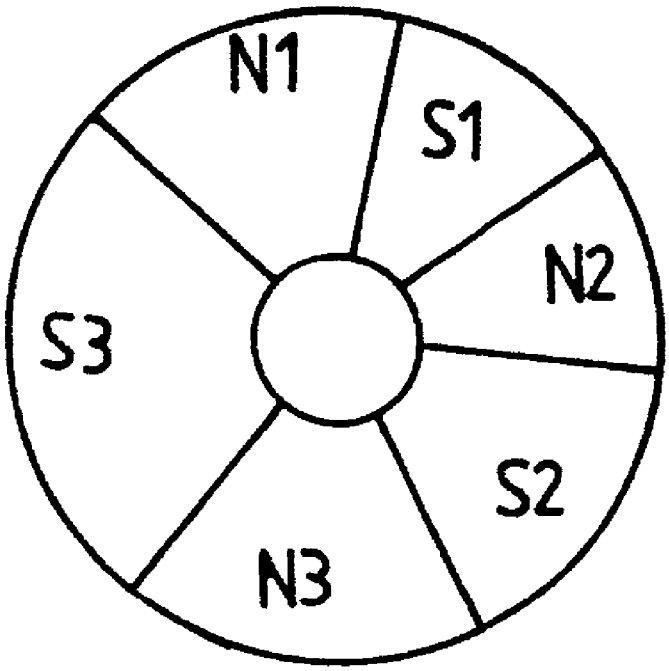
(Prior Art) FIG. 8C
FIG. 8C is a view showing a structure of the conventional magnetic roller in which separated cylindrical pieces are arranged to each other without any intervals therebetween.

FIGS. 7A to 7C show the characteristic curves and the structure of the magnetic roller 6 applied to the present invention, and FIGS. 8A to 8C show the characteristic curves and the structure of the conventional magnetic roller for comparison with the magnetic roller 6 applied to the present invention.

As shown in above Figures, since the magnetic roller 6 is comprised of the block magnets 24 which are respectively formed in a rectangular shape and are disposed at angles $\alpha,\beta,\gamma,\epsilon,\delta$ apart from each other, the characteristic curve of the normal force of the magnetic roller 6 is a cubic curve with curvature change points, instead of a quadratic curve between the magnetic poles. This feature is visible more clearly in the curve of the tangential force. Particularly, a feature of a biquadratic curve is clearly appeared between the magnetic poles N2~S2, S2~N3, N3~S3 in which the arranging intervals thereof are large. By contrast, the conventional magnetic roller in FIGS. 8A to 8C is comprised of several separated cylindrical pieces which are arranged without any intervals between each other. In this case, the characteristic curve of the normal force between the magnetic poles is generally a quadratic curve, and the characteristic curve of the tangential force of the conventional magnetic roller is likewise.

The operation of the developing machine, as constructed above, is described more fully. FIGS. 6A to 6C show a flow of a developing agent 3 in the developing part 11. In FIG. 6A, if a small quantity of the developing agent 3 is supplied to a developing roller 5, while a developing roller 5 is rotated in a direction indicated by arrow 50, the developing agent 3 is coated on a face of the developing roller 5 by a magnetic force of the magnetic roller 6 which is disposed in the developing roller 5. The height of the developing agent 3 coated on the developing roller 5 is restricted by the doctor blade 7. In addition, the developing agent 3 coated on the developing roller 5 is returned to the developing part 11 according to the rotation of the developing roller 5. At this time, since there is a large difference between an input amount In and output amount lo of the developing agent 3 at a front and rear of the doctor blade 7(In>Io), the developing agent 3 which is not passed through the doctor blade 7 is pushed out by the doctor blade 7 and flows along the slanted face 9.

Since the developing agent 3 is returned in the developing part 11, a collision between the returning developing agent 3 and the flow of the developing agent 3 along the slanted face 9 is generated. Therefore, the developing agent 3 returning in the developing part 11 accumulates more and more. That is, as shown in FIG. 6B, the developing agents 3 on the upper and lower portions of the developing part 11 collide with each other in proportion to the increase of the density of the developing agent 3 on the upper portion of the developing part 11 and the quantity of the developing agent 3 on the lower portion of the developing part 11.

Since the developing agent 3 on the lower portion of the developing part 11 changes the direction of the flow of the developing agent 3 from the slanted face 9 toward the developing roller 5, the developing agent 3 is not removed to the toner supplying part 12, but is accumulated at the border face 25 between the developing part 11 and the toner supplying part 12. That is, the speed of movement of the developing agent 3 at the border face 25 is zero. Therefore, although the developing agent 3 is supplied from the toner supplying part 12 to the developing part 11, the developing agent 3 does not flow to the developing part 11.

The above description is of the case when developing roller 5 is raced. Actually, when printing an image, the developing agent 3 is consumed in order to develop an electrostatic latent image on a photosensitive drum 2. The volume of the developing agent 3 in the developing part 11 is decreased as it is consumed. The decreased volume of the developing agent 3 is refilled by the developing agent 3 from the toner supplying part 12. That is, the toner supplying mechanism is realized using a stagnant area (i.e. zero speed area) at the border face 25.

However, if the image to be printed is formed on a part of the developing roller 5, the toner 4 is consumed only at a part of the developing roller 5. In this situation, the toner 4 can be supplied through the border face 5 corresponding to the consumed part of the toner and it can be also supplied by a flow of an axial direction of the developing roller 5 in the developing part 11. In this case, since an axial imbalance of a concentration of the toner 4 is generated according to a kind of the image to be printed, a picture quality is decreased. This results from using the conventional magnetic roller 6 as shown in FIGS. 8A to 8C.

According to the present invention, since the block magnets 24 (for example, N2, S2) of the magnetic roller 6 are discontinuously disposed at each arranging angle, curvature change points occur in the tangential force between the magnetic poles N2, S2. The tangential force of the magnetic flux is maximal at the curvature change points. Therefore, the toner 4 is fully supplied to the consumed area of the developing part 11, thereby preventing the decrease of the picture quality.

In addition, the developing machine according to the present invention does not use a sensor for detecting the concentration of the toner, thereby decreasing the manufacturing cost.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A developing machine comprising:

a photosensitive drum for holding an electrostatic latent image;

a developing roller for supplying a developing agent to the photosensitive drum;

a doctor blade for controlling a thickness of a developing agent layer on the developing roller;

a slanted face formed on the doctor blade slanted to the doctor blade and adjacent to the developing roller, for preventing a movement of the developing agent;

a blocking jaw on the end of the slanted face, for blocking the developing agent so that a flow of the developing agent is generated; and a magnetic roller mounted in the developing roller, said magnetic roller comprising of a plurality of block magnets which are radially arranged discontinuously and alternately in field.

2. The developing machine of claim 1, said slanted face being integrally formed on said doctor blade.

3. The developing machine of claim 1, said blocking jaw being integrally formed on said slanted face.

4. The developing machine of claim 3, said blocking jaw having a height in the range of approximately 1.7 to 2.0 mm and a width in the range of approximately of 2 to 3 mm.

5. The developing machine of claim 1, said magnetic roller being comprised of six block magnets.

6. The developing machine of claim 5, said block magnets being rectangular magnets.

7. The developing machine of claim 6, five of the block magnets being respectively disposed at angles relative to a first of said block magnets of in the ranges of approximately 35° to 45°, 80° to 90°, 145° to 155°, 215° to 225°, and 295° to 305°.

8. The developing machine of claim 7, said doctor blade being disposed at a position radially in between said block magnet disposed in the angle range of 80° to 90° and said block magnet disposed in the angle range of 145° to 155° relative to said first block magnet.

9. The developing machine of claim 7, said blocking jaw being disposed at a position in which the normal force due to the magnetic field of the magnetic roller is at a minimum and the tangential force due to the magnetic field is at a maximum.

10. The developing machine of claim 6, said blocking jaw being disposed at a position in which the normal force due to the magnetic field of the magnetic roller is at a minimum and the tangential force due to the magnetic field is at a maximum.

11. The developing machine of claim 5, said doctor blade being disposed at a position in which the normal force due to the magnetic field of the magnetic roller is at a minimum and the tangential force due to the magnetic field is at a maximum.

12. The developing machine of claim 5, said blocking jaw being disposed at a position in which the normal force due to the magnetic field of the magnetic roller is at a minimum and the tangential force due to the magnetic field is at a maximum.

13. The developing machine of claim 5, the characteristic curve of tangential force of the magnetic roller having six maxima and six minima around the circumference.

14. The developing machine of claim 1, said doctor blade being disposed at a position in which the normal force due to the magnetic field of the magnetic roller is at a minimum and the tangential force due to the magnetic field is at a maximum.

15. The developing machine of claim 1, further comprising:

a developing part adjacent to the developing roller and below the doctor blade;

a toner supplying part for supplying toner to the developing part;

a hopper for supplying the toner to the toner supplying part; and a blocker which is disposed between the toner supplying part and the hopper for preventing a considerable amount of toner from gathering into the developing part.

16. The developing machine of claim 15, further comprising anon-magnetic border face between the developing part and the toner supplying part, said border face projecting toward said blocking jaw and forming a gap with an edge of said blocking jaw.

17. The developing machine of claim 16, said border face being disposed at a position in which the normal force due to the magnetic field of the magnetic roller is at a minimum and the tangential force due to the magnetic field is at a maximum.

18. The developing machine of claim 16, said magnetic roller being comprised of six block magnets, five of the block magnets being respectively disposed at angles relative to a first of the block magnets of in the ranges of approximately 35° to 45°, 80° to 90°, 145° to 155°, 215° to 225°, and 295° to 305°; and said border face being disposed at a position radially in between said block magnet disposed at 145° to 155° and said block magnet disposed at 215° to 225°.

19. The developing machine of claim 1, said blocking jaw being disposed at a position in which the normal force due to the magnetic field of the magnetic roller is at a minimum and the tangential force due to the magnetic field is at a maximum.

20. The developing machine of claim 1, the characteristic curve of tangential force of the magnetic roller being cubic in shape with distinct changes in curvature.

* * * * *